United States Patent [19]

Sutcliffe

[11] Patent Number: 4,996,745

[45] Date of Patent: Mar. 5, 1991

[54] FLAT FOR A CARDING ENGINE

[75] Inventor: Brian C. Sutcliffe, Halifax, England

[73] Assignee: Crosrol Limited, Holmfield, England

[21] Appl. No.: 479,386

[22] Filed: Feb. 13, 1990

[30] Foreign Application Priority Data

Feb. 14, 1989 [GB] United Kingdom ..... 8903262

[51] Int. Cl.[5] ..... D01G 15/24; D01G 15/28

[52] U.S. Cl. ..... 19/104; 19/103; 19/113; 19/114

[58] Field of Search ..... 19/98, 102, 103, 104, 19/107, 108, 109, 113, 114

[56] References Cited

U.S. PATENT DOCUMENTS

| | | | |
|---|---|---|---|
| 453,060 | 5/1891 | Canning | 19/103 |
| 3,995,351 | 12/1976 | Otani | 19/102 |
| 4,001,917 | 1/1977 | Taylor | 19/104 |
| 4,162,559 | 7/1979 | Stewart | 19/113 |
| 4,221,023 | 7/1980 | Henderson et al. | 19/113 |
| 4,286,357 | 9/1981 | Harrison, Sr. | 19/104 |
| 4,314,387 | 2/1982 | Löffler | 19/104 |
| 4,593,437 | 6/1986 | Graf et al. | 19/113 |
| 4,651,387 | 3/1987 | Giuliani | 19/113 |

FOREIGN PATENT DOCUMENTS

| | | | |
|---|---|---|---|
| 0195756 | 9/1986 | European Pat. Off. | 19/104 |
| 0233370 | 12/1986 | European Pat. Off. | |
| 0139822 | 7/1985 | Japan | 19/113 |
| 9229 | of 1895 | United Kingdom | 19/104 |
| 578571 | 7/1946 | United Kingdom | 19/113 |
| 1353735 | 7/1970 | United Kingdom | |

*Primary Examiner*—Werner H. Schroeder
*Assistant Examiner*—John J. Calvert
*Attorney, Agent, or Firm*—Darby & Darby

[57] ABSTRACT

A flat for a carding engine comprises an elongate support bar (11) designed to be supported at each end thereof on a bend at the respective side of the carding engine. Carding elements (19) are carried by an elongate carrier (14), the support bar and carrier having interengaging formations (15,16) which restrain these parts against relative lateral movement. Adjusting means (24,25) are provided in at least two spaced locations along the support bar for adjusting the spacing between the support bar and the carrier. Each adjusting means has an associated locking means (23) for releasably locking the support bar and the carrier in an adjusted position in order to achieve a required setting of the carding elements in relation to the main carding cylinder.

18 Claims, 3 Drawing Sheets

FLAT FOR A CARDING ENGINE

This invention relates to a flat for a carding engine, and to a carding engine equipped with a set of flats.

The need for setting the flats of a carding engine accurately with respect to the main carding cylinder is well known. The distance between the tips of the working carding elements on the flats and the tips of the carding elements on the cylinder should be as uniform as possible from flat to flat, and it is also desirable that the setting be as low as possible in order to produce a quality carded web.

These setting problems occur both where the flats are stationary, i.e. are fixed in place on the bends to either side of the carding cylinder, or where the flats are movable and are joined together in a continuous chain. In the latter case the ends of each flat are supported on the bend at the respective side of the cylinder, either for sliding movement relative to the bend, or for rolling movement if rollers or wheels are secured to the ends of the flats.

In any of these previous constructions, adjustment of individual flats has taken place by adjusting the setting of the end of the flat relative to the bend. Many types of adjustment arrangements have been proposed, some being more effective than others. The present invention adopts a totally different approach to the setting of flats, and can allow independent accurate setting of each flat to be effected more simply and rapidly than in prior arrangements.

According to the invention a flat for a carding engine comprises an elongate support bar, an elongate carrier for carding elements, means restraining the support bar and the carrier against relative lateral movement, adjusting means in at least two locations along the support bar for adjusting the spacing between the support bar and the carrier, and locking means for releasably locking the support bar and the carrier in an adjusted position.

In effect, the invention splits the whole of the flat into two main parts, a support bar and a carrier. When in position on a carding cylinder the carding elements that will be present on the underside of the carrier confront the carding elements on the cylinder. The upper surface of the carrier faces the lower surface of the support bar and the spacing between these faces can be adjusted by the adjusting means. The lower surface of the support bar and the upper surface of the carrier are restrained against relative lateral movement in any of the adjusted positions. That restraint against lateral movement includes restraint against twisting of the carrier relative to the support bar about the longitudinal axis of the assembly. Adjustment is effected by adjusting the carrier relative to the support bar, rather than by adjusting the flat or any part thereof relative to the bend, or by adjusting the bend relative to the cylinder. It will thus readily be seen that every flat can be individually adjusted, totally independently of any of the other flats.

Preferably the means for effecting lateral restraint comprise interengaging formations on the support bar and carrier. Other restraining means are possible, and if the adjusting means are sufficiently stiff then they may also function as restraining means.

When the interengaging formations are provided they are desirably of substantially constant cross-section throughout the length of the support bar and of the carrier, and desirably the support bar and the carrier are both extrusions. Extruded constructions are not essential, however, and it will readily be seen that the flats may be constructed in different ways. Use of formations that interengage throughout the length of the flat are preferred, as in this way the maximum protection against relative lateral movement and twisting can be achieved. The interengaging formations should be of a close fit one within the other. Desirably the female part of the interengaging formations is on the support bar and the male part on the carrier, although this may of course be reversed.

The carrier itself may have carding elements formed on that surface of the carrier which will confront the cylinder. However, it is more desirable that the carding elements be secured to the carrier. Preferably the carrier is shaped so that a strip of card clothing may be clipped thereto, although it is also possible to adhere card clothing to the carrier. The carding elements on the carrier may be of any required type, from the conventional wire clothing to the so-called granular or other carding element arrangements.

The adjusting means may conveniently be a screw extending through a tapped bore in the support bar and having an end engaging the carrier. The adjusting screw may be hollow, and the locking means may then be a bolt extending through a bore in the adjusting screw and into a tapped bore formed in the carrier. In this way adjustment and locking are effected as close as possible one to the other. However, in alternative arrangements the adjusting means and the locking means may be longitudinally spaced one from the other.

It is not necessary to use a screw or bolt type of adjusting means. Thus, in a first alternative the adjusting screw may be replaced by an adjusting sleeve passing freely through a bore in the support bar into contact with the carrier, shims being inserted between the support bar and a head of the sleeve to achieve the required adjustment. In a second alternative arrangement, adjustment may be effected by means of shims between the support bar and the carrier, appropriate shims being inserted in place, and the support bar and carrier then being locked together by a bolt or other locking arrangement. In an third alternative the carrier may be adjusted by an eccentric arrangement housed within the support bar and adjustable by a rotatable element exposed at a side surface of the support bar.

Desirably, adjusting means are located adjacent to each end of the support bar and also in at least one location intermediate the ends of the support bar. Flats extend across the full width of the carding cylinder, and a recognised problem is that of bowing or sagging of the flats in the centre of the cylinder. This has the effect of causing the setting between the carding elements of the flats and cylinder to be greater or smaller at the centre of the cylinder than at the edges thereof. By incorporating one or more adjusting means in the centre region of the support bar it will be seen that such bowing or sagging can be eliminated, simply by setting and locking to a different adjustment at the centre of the support bar than at the ends thereof. Furthermore, if different settings are actually required across the width of the cylinder then this can be achieved through the use of intermediate adjusting means.

A further recognised problem with carding engines is the blowing out of fibre and waste through the space between adjacent flats, particularly in the type of carding engine having movable flats, the flats being connected together by chains at each side of the carding engine and being driven around a closed loop by block wheels. As the flats move round the block wheels, adjacent flats tilt one with respect to the other and the gap between the carding element section of the flats opens. In a flat according to the invention, sealing can readily be effected by securing a flexible sealing strip to the support bar to extend the length of that bar, the strip being such as to be engageable with the support bar of a next adjacent flat. By suitable shaping and dimensioning of the strip, that engagement can be maintained throughout the full path of travel of the flats, even when passing round the block wheels. The problems of blow-out can thus be significantly reduced. In will be understood that sealing strips can also be used in conjunction with stationary flats, and can then substantially eliminate blow-out.

The invention also extends to a carding engine when equipped with a set of flats as aforesaid.

In order that the invention may be better understood specific embodiments thereof will now be described in more detail, by way of example only, with reference to the accompanying drawings in which.

Figure 1:
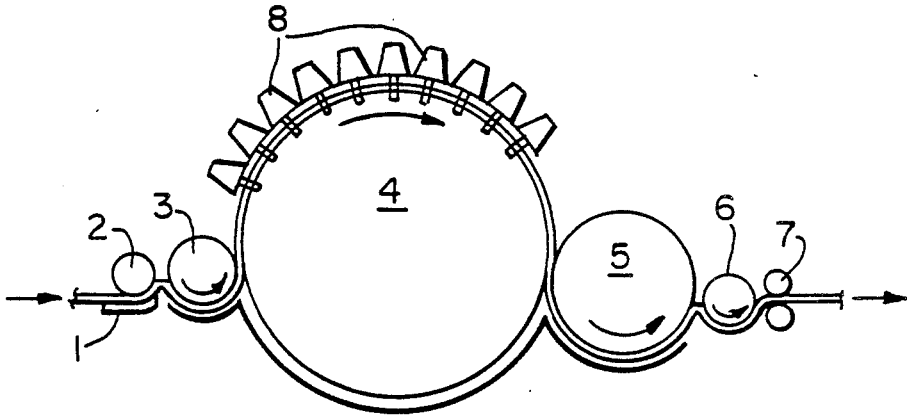
FIG. 1 is a schematic representation of a carding engine equipped with flats according to the invention.

Referring now to FIG. 1 this illustrates a carding engine comprising a feed plate 1, feed roller 2, takerin 3, main carding cylinder 4, doffer 5, stripper roll 6 and take-off arrangement 7. The carding engine is equipped with a plurality of flats such as 8 each extending the full width of the carding engine and fixed at each end to a bend of the carding engine.

As shown in FIGS. 2 to 5, each flat shown therein comprises an elongate support bar 11 and an elongate carrier 12, both the support bar and the carrier being formed as extrusions, desirably of aluminium. The lower face 13 of the support bar confronts the upper face 14 of the carrier and is formed with a recess 15 into which protrudes a rib 16 extending upwardly from the carrier. The rib 16 is a close fit within the recess 15 and restrains the carrier against lateral movement relative to the support bar, and also against twisting movement relative to the support bar around an axis extending longitudinally thereof. The upper surface 14 of the carrier is formed with shoulder sections 17 to which may be clipped a strip 18 formed with card clothing 19.

The support bar has a cut away section 20 at each end thereof, and a tapped bore 21 extends through the support bar adjacent to the end thereof. The lower end of an adjusting screw 22 lies in contact with the upper face of the rib 16. The screw 22 is hollow and has a central bore 23 through which a bolt 24 extends, the bolt having a threaded section which engages a tapped bore 25 formed in the carrier 12. It will be seen that by adjustment of the screw 22 the setting A of the teeth of the carding elements relative to the lower surface 13 of the support bar can be adjusted, the carrier being locked in the adjusted position by the bolt 24.

Figure 2:
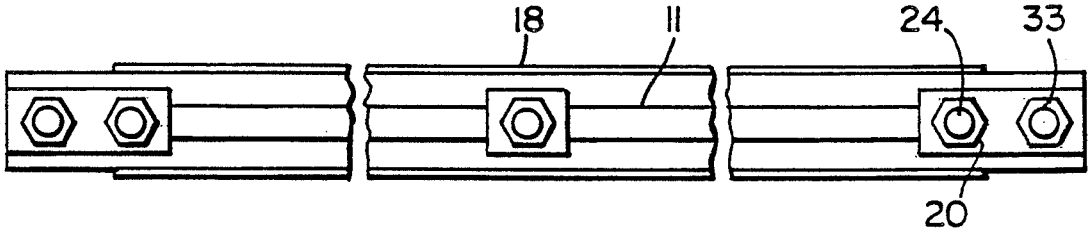
FIG. 2 is a top plan view of a first embodiment of flat in accordance with the invention.

A similar adjusting mechanism is provided at the other end of the flat, and also at one (as shown in FIG. 2) or more spaced locations along the length of the flat. At the intermediate locations the support bar is cut away as necessary to accommodate the adjusting screw and locking bolt. Provision of these intermediate adjustment locations means that adjustment is possible to compensate for any bowing or sagging of the flat in the centre region of the cylinder.

Figure 3:
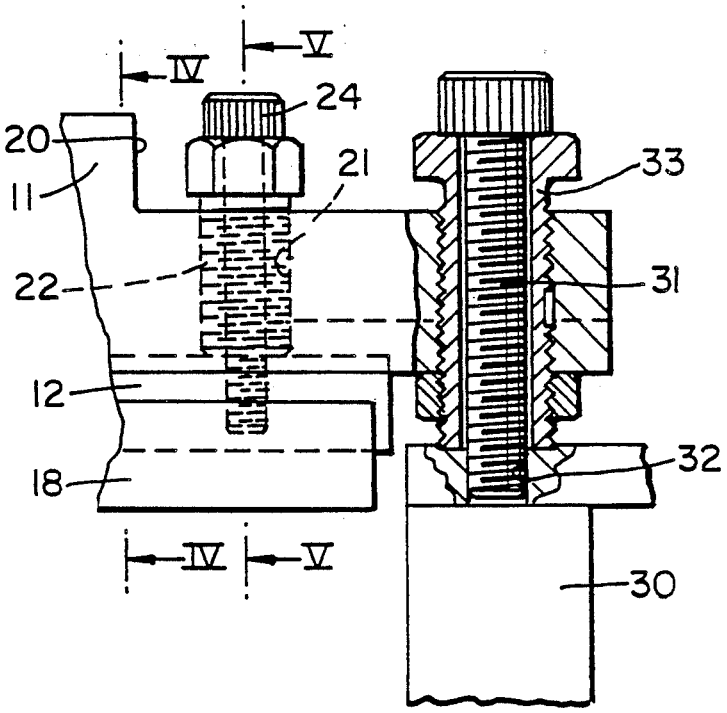
FIG. 3 is an enlarged part elevation, part section of one end of the flat of FIG. 2.

Each end of the flat may be supported on the bend 30 at the respective side of the carding engine in any suitable manner. FIG. 3 shows the flat fixed in position on the bend by a bolt 31 threaded into a tapped bore 32 on a support member secured to the bend. If desired adjustment of the whole flat relative to the bend 30 is possible by incorporating a further adjusting sleeve 33 in the end region.

Figure 4:
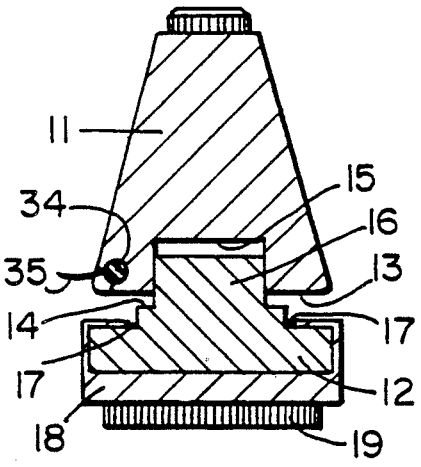
FIGS. 4 and 5 are cross-sections on the lines IV—IV and V—V respectively of FIG. 3.
Figure 5:
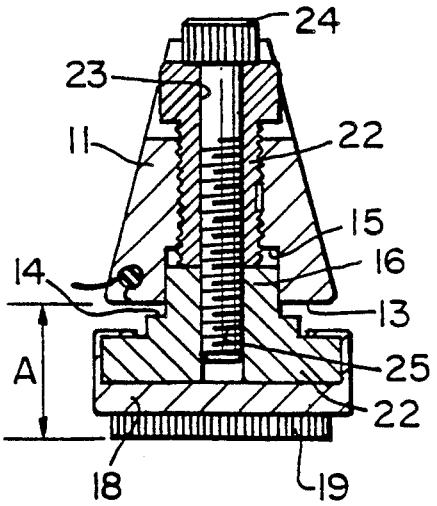

FIGS. 4 and 5 show that the support bar may, if desired, be formed with a longitudinally extending channel 34 into which can be fitted a bead of a flexible seal 35, desirably of rubber or fabric, also extending the length of the support bar. The seal may be shaped and sized so that it will bear on the support bar of an immediately adjacent flat, and so prevent blow-out of material through the space between the two flats.

Figure 6:
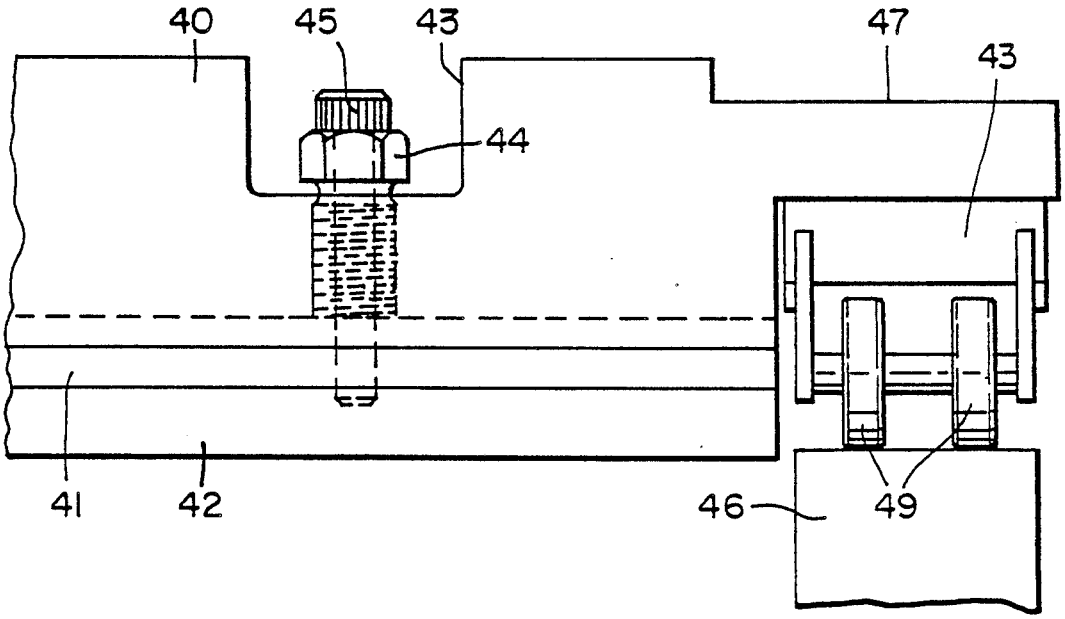
FIG. 6 is an elevation of part of the end of a second embodiment of flat according to the invention.

FIG. 6 shows the end section of a second embodiment of flat which, as with the flat described, comprises an elongate support bar 40 and an elongate carrier 41 to which a strip 42 of card clothing is clipped. The end section of the flat is cut away at 43 to accommodate an adjusting sleeve 44 and locking bolt 45 similar to those shown in FIG. 5.

In this embodiment the flat is movable relative to the bend 46, an end part 47 of the flat being supported by a carriage 48 bolted to the end section 47, the carriage being formed with wheels or rollers 49 running on the bend. In an alternative arrangement, the flat may have an attached or integral end section that is simply slidable on the band as the flat moves.

As with the FIG. 3 embodiment, the flat shown in FIG. 6 will have adjusting and locking means at each end of the flat, and at one or more intermediate locations along the flat. It may also be equipped with a seal similar to the seal 35, which will effect sealing at all times, even when the flats are passing round the block wheels during their travel from the cylinder surface onto the return path of the closed loop.

Figure 7:
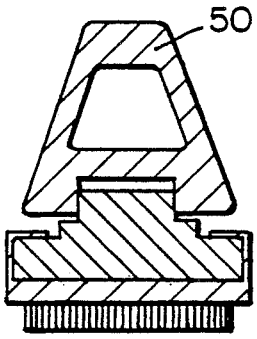
FIGS. 7 to 9 are cross-sections through yet further embodiments of flats according to the invention.
Figure 8:
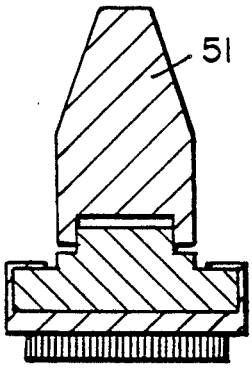
Figure 9:
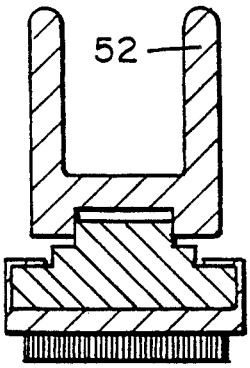

It will be appreciated that the cross-section of the support bar and of the carrier may differ from the cross-sections shown in FIGS. 4 and 5. Merely by way of example, FIGS. 7 to 9 show different sections of support bar 50, 51, 52, each having an associated carrier. The shape of the interengaging formations between the support bar and the carrier may differ from those shown, as long as the necessary restraint against relative lateral and twisting movement between the support bar and the carrier is provided.

I claim:

1. A flat for a carding engine, the flat comprising an elongate support bar having opposite first and second ends provided with means for operatively engaging respective bends at opposite sides of the carding engine, an elongate carrier for carding elements, means restraining the support bar and the carrier against relative lateral movement, adjusting means in at least two locations along the support bar for adjusting the spacing between the support bar and the carrier, and locking means for releasably locking the support bar and the carrier in an adjusted position.

2. A flat according to claim 1 in which the means for effecting lateral restraint comprise interengaging formations on the support bar and carrier.

3. A flat according to claim 2 in which the interengaging formations are of substantially constant cross-section throughout the length of the support bar and of the carrier.

4. A flat according to claim 1 in which the support bar and the carrier are extrusions.

5. A flat according to claim 1, in which the carrier is shaped so that a strip of card clothing may be clipped thereto.

6. A flat according to claim 1, in which the adjusting means comprises a screw extending through a tapped bore in the support bar and having an end engaging the carrier.

7. A flat according to claim 6 in which the adjusting screw is hollow and the locking means is a bolt extending through a bore in the adjusting screw and into a tapped bore formed in the carrier.

8. A flat according to claim 1 in which a flexible sealing strip is secured to and extends the length of the support bar, the strip being such as to be engageable with the support bar of a next adjacent flat.

9. A carding engine having a carding cylinder, first and second bends at opposite sides of said carding cylinder, and a plurality of flats in operative relationship with said carding cylinder, each said flat comprising an elongate support bar having opposite first and second ends provided with means for operatively engaging respective ones of said first and second bends, an elongate carrier for carding elements, restraining means restraining said support bar and said carrier against relative lateral movement, first adjusting means adjacent to said first end of said support bar, second adjusting means adjacent to said second end of said support bar, at least one further adjusting means located intermediate said first and second adjusting means, each of said adjusting means being operative to adjust the spacing between said support bar and said carrier in the vicinity of that adjusting means, and locking means for releasably locking said support bar and said carrier in an adjusted position.

10. A carding engine having a carding cylinder, first and second bends at opposite sides of the carding cylinder, and a plurality of flats in operative relationship with the carding cylinder, each said flat comprising an elongate support bar having opposite first and second ends provided with means for operatively engaging the respective bends, an elongate carrier for carding elements, means restraining the support bar and the carrier against relative lateral movement, adjusting means in at least two locations along the support bar for adjusting the spacing between the support bar and the carrier, and locking means for releasably locking the support bar and the carrier in an adjusted position.

11. A flat for a carding engine, said flat comprising an elongate support bar having opposite first and second ends provided with means for operatively engaging respective bends at opposite sides of said carding engine, an elongate carrier for carding elements, restraining means restraining said support bar and said carrier against relative lateral movement, first adjusting means adjacent to said first end of said support bar, second adjusting means adjacent to said second end of said support bar, at least one further adjusting means located intermediate said first and second adjusting means, each of said adjusting means being operative to adjust the spacing between said support bar and said carrier in the vicinity of that adjusting means, and locking means for releasably locking said support bar and said carrier in an adjusted position.

12. The flat of claim 11 wherein said restraining means comprise interengaging formations on said support bar and on said carrier.

13. The flat of claim 12 wherein said interengaging formations are of substantially constant cross-section throughout the length of said support bar and of said carrier.

14. The flat of claim 11 wherein said support bar and said carrier each comprises an extrusion.

15. The flat of claim 11 wherein said carding elements comprise a strip of card clothing, and clip means are provided for clipping said strip to said carrier.

16. The flat of claim 11 wherein each of said adjusting means comprises an adjusting screw extending through a tapped bore in said support bar and having an end engaging said carrier.

17. The flat of claim 16 wherein an individual locking means is associated with each of said adjusting means, each adjusting screw is hollow and each locking means is a bolt extending through a bore in the respective one of said adjusting screws and into a tapped bore formed in said carrier.

18. The flat of claim 11 wherein a flexible sealing strip is secured to and extends the length of said support bar, said sealing strip being such as to be engageable with the support bar of a next adjacent flat.

* * * * *